US005368629A

United States Patent [19]

Kondo et al.

[11] Patent Number: 5,368,629

[45] Date of Patent: Nov. 29, 1994

[54] ROTOR FOR OIL PUMP MADE OF ALUMINUM ALLOY AND METHOD OF MANUFACTURING THE SAME

[75] Inventors: Katsuyoshi Kondo; Yoshinobu Takeda, both of Itami, Japan

[73] Assignee: Sumitomo Electric Industries, Ltd., Osaka, Japan

[21] Appl. No.: 949,646

[22] PCT Filed: Apr. 3, 1992

[86] PCT No.: PCT/JP92/00414

§ 371 Date: Dec. 3, 1992

§ 102(e) Date: Dec. 3, 1992

[87] PCT Pub. No.: WO92/17302

PCT Pub. Date: Oct. 15, 1992

[30] Foreign Application Priority Data

| | | | |
|---|---|---|---|
| Apr. 3, 1991 | [JP] | Japan | 3-71115 |
| Apr. 15, 1991 | [JP] | Japan | 3-82476 |
| May 23, 1991 | [JP] | Japan | 3-118658 |
| Aug. 6, 1991 | [JP] | Japan | 3-196582 |

[51] Int. Cl.[5] ..... B22F 3/14; C22C 1/04; C22C 21/02

[52] U.S. Cl. ..... 75/249; 148/513; 148/514; 419/28; 419/39; 419/48; 419/55; 419/57; 420/549

[58] Field of Search ..... 75/249; 148/438, 440, 148/549, 550, 513, 514; 420/549, 551, 553, 537, 535, 538, 544; 419/28, 39, 48, 55, 57

[56] References Cited

U.S. PATENT DOCUMENTS

| | | | |
|---|---|---|---|
| 4,135,922 | 1/1979 | Cebulak | 75/143 |
| 4,681,519 | 7/1987 | Sakamaki et al. | 418/152 |
| 4,729,790 | 3/1988 | Skinner | 75/249 |
| 4,889,557 | 12/1989 | Iwata et al. | 75/249 |
| 4,898,612 | 2/1990 | Gilman et al. | 75/249 |
| 4,917,739 | 4/1990 | Adam et al. | 148/437 |
| 4,923,676 | 5/1990 | Faure | 420/535 |
| 5,199,971 | 4/1993 | Akechi | 75/249 |

FOREIGN PATENT DOCUMENTS

| | | |
|---|---|---|
| 60-116753 | 6/1985 | Japan . |
| 61-84343 | 4/1986 | Japan . |
| 63-42344 | 2/1988 | Japan . |
| 63-192838 | 8/1988 | Japan . |
| 64-05621 | 1/1989 | Japan . |
| 2050902 | 2/1990 | Japan . |
| 232324 | 9/1990 | Japan . |
| 2225635 | 9/1990 | Japan . |

OTHER PUBLICATIONS

Patent Abstracts of Japan; vol. 11, No. 67 (M-566) 28 Feb. 1987; & JP-A-61 223-282 (Honda Motor Co. Ltd.); 3 Oct. 1986; abstract.

Chemical Abstracts, vol. 111, No. 18; Columbus, Ohio, abs No. 158773, Akechi, Kiyoaki 'Extrusion of alumi- (List continued on next page.)

*Primary Examiner*—Donald P. Walsh
*Assistant Examiner*—Ngoclan T. Mai
*Attorney, Agent, or Firm*—Wenderoth, Lind & Ponack

[57] ABSTRACT

The rapidly solidified aluminum alloy powder is preformed in a cold or warm environment to form a powder compact having a relative density of 75-93%. Then, the preformed compact is heated and degassed in the atmosphere of an inert gas at temperature of 300° C. to 560° C. for 0.25-3 hours. Immediately thereafter, the compact is subjected to hot coining at 300°-560° C. to obtain a solidified compact having pores at a rate of 2-5%. The solidified compact is then subjected to sizing. Since the inorganic gas prevents reaction between the evaporated water and aluminum while preheating the compact, the hot coining can be carried out in a state where solid state diffusion easily occurs. Thus, the powder particles can be bonded together strongly with a single forging. Also, at the end of hot coining, pores remain in the solidified compact at the rate of 2-5%. Utilizing these pores, the compact can be subjected to sizing to improve its dimensional accuracy. The rotor for an oil pump thus formed can withstand use at high temperatures.

4 Claims, 1 Drawing Sheet

* Sizing capability is indicated in the form of error when the circularity was measured for a solidified member having an outer diameter of 30 mm (after sizing at normal temperatures and pressure of 6 t/cm²).

OTHER PUBLICATIONS num alloy for rotors'; abstract; & JP-A-1 005 621 (Sumitomo Electric Industries, Ltd.) 10 Jan 1989.

Chemical Abstracts, vol. 111, No. 20; Columbus, Ohio; abstract No. 179275, Akechi, Kiyoaki 'Compressor rotor from processing of aluminum alloy powder'; abstract; & JP-A-1 011 911 (Sumitomo Electric Industries, Ltd.); 17 Jan. 1989.

Chemical Abstracts, vol. 114, No. 8; Columbus, Ohio; abstract No. 67383, Matsumoto, Hidemiki et al., 'Rapidly solidified aluminum-silicon alloys resistant to heat and wear'; abstract; & JP-A-2 061 021 (Furukawa Aluminum Co., Ltd.); 1 Mar. 1990.

Chemical Abstracts, vol. 110, No. 20; Columbus, Ohio; abstract No. 177925, Inoue, Hidetoshi et al. 'Aluminum alloys of low thermal expansion and high elasticity'; abstract; & JP-A-63 219 546 (Kobe Steel, Ltd.); 13 Sep. 1988.

Patent Abstracts of Japan; vol. 12, No. 283 (C-518) 29 Aug. 1986; & JP-A-63 060 265 (Mitsubishi Metal Corp); 16 Mar. 1988; abstract.

* Sizing capability is indicated in the form of error when the circularity was measured for a solidified member having an outer diameter of 30 mm (after sizing at normal temperatures and pressure of 6 t/cm$^2$).

ROTOR FOR OIL PUMP MADE OF ALUMINUM ALLOY AND METHOD OF MANUFACTURING THE SAME

TECHNICAL FIELD

The present invention relates to a rotor for an oil pump such as an oil pump for use in an automatic transmission (A/T).

BACKGROUND ART

Demand for cars that consume less fuel is strong these days. One way to improve the fuel efficiency is to reduce the overall weight of a car. In order to reduce the car weight, efforts are being made to reduce the weight of individual component parts of a car.

In this respect, it is considered highly important to reduce the weight of an oil pump, because 1) by reducing the weight of the pump and its peripheral parts and 2) by reducing the weight of frictional and rotary parts thereof, one can expect improved pumping capacity. For example, in case of a conventional oil pump for use in an automatic transmission, its part (pump case) is made of iron (mainly cast or diecast iron) and it weighs more than 5 kg. If the same part is made of an aluminum alloy, its weight will be less than 2 kg, which corresponds to about 60% weight reduction. Such a lightweight pump will show improved pumping capacity.

Heretofore, in generating a high-precision toothed part (gear) configured in a trochoid or involute curve by using a ferrous sintered part, the sizing technique has been employed in which pores remaining in the sintered part at the rate of 10–20% are partially closed by applying pressure, thus locally deforming the sintered part into the shape complementary to the metal mold, without giving any noticeable plastic deformation. The gear thus made has a high dimensional accuracy.

On the other hand, it is virtually impossible to apply such a sintering process to a part made of aluminum powder alloy, because, in case of an aluminum alloy powder, the oxide layer formed on the surface thereof tends to inhibit the diffusion and sintering. Sintering is applicable only in a eutectic liquid phase which appears at an extremely high temperature. But such a sintering operation tends to severely damage the microscopic and uniform metastable alloy phase obtained by the rapidly solidifying method or the mechanical alloying method and is thus practically meaningless. Furthermore, if a material made by solidifying aluminum powder should have pores at the rate of 10–20% as in the case of a ferrous sintered material, such a material could never be used for sliding members because its strength is extremely low.

Also, in generating a member made of aluminum powder alloy using the powdered metal technique, the aluminum alloy powder is molded and solidified in the cold and then is hot-forged. The heat produced by hot-forging tends to expand and shrink the mold and the solidified material, thus causing a change in the dimensions of the solidified material. It was therefore difficult to generate a part which is comparable in dimensional accuracy to a ferrous sintered part, with the heat-forging technique alone. If the solidified powder compact has a true density, what is done will be re-forging rather than sizing. Thus, it is impossible to improve the dimensional accuracy.

Also, if a rotor of an oil pump is made of one of various known aluminum alloys, such a rotor will have the following problems.

(1) If the rotor is made of an aluminum ingot metallurgy (I/M), which has heretofore been used as a slide member such as a piston or a bearing, such as AC8B and A390, its tooth surface would suffer severe wear damage resulting from pitching wear due to insufficient strength against frictional wear between aluminum alloys and surface pressure fatigue. Also, severe adhesion wear will appear at the end face and the outer peripheral portion due to seizure between the pump and the case. Further, when the rotor is rotating at high speed, fatigue failure may occur at the joint portion with the shaft due to insufficient strength of the rotor. Also, since cold forging cannot generate a precise and complicated shape, machining is further needed. As the percentage of Si increases, the primary crystal of Si becomes too coarse. This reduces the strength and toughness. On the other hand, in order to attain a sufficient high-strength temperature, the content of Fe has to be between 3 and 10%. But in case of ingot metallurgy, if the content of Fe is more than 5%, coarse needle-like structure will result, which lowers the toughness of the alloy.

(2) If a rotor is made of a powder alloy composed of Al with Si contained at a high rate by use of the rapidly solidifying powder metallurgical technique, its thermal expansion coefficient becomes lower than that of the pump case material because it contains Si at a high rate. If it does a sliding movement at a temperature of about 150° C., the clearance between the case and the rotor will increase, thus lowering the pumping capacity. Also, the alloy material of which the rotor is made is low in high-temperature strength. Thus, it is difficult to use this material for manufacturing a rotor which is used at a temperature of about 150° C., i.e. a rotor to which the present invention relates.

(3) If a rotor is made of a Al-Zn powder alloy composed of Al with Zn contained at a high rate, obtained by the rapidly solidifying powder metallurgical technique, its wear resistance will be poor though it shows good high-temperature strength due to remarkable age hardening characteristics. Thus, this material is not suitable as a material for a rotor for which a high wear resistance is required, that is, a rotor to which the present invention relates.

In order to retain excellent properties as a solidified body by use of high-performance aluminum alloy powder obtained by the rapidly solidifying method or the mechanical ironing method, the aluminum alloy powder particles have to be bonded together perfectly. But an oxide aluminum film covering each powder particle tends to inhibit such bonding. Generally, it is possible to remove sufficiently or break and destroy the oxide layer by selecting the heating and pressurizing conditions properly, so that the powder particles will be bonded together strongly, developing metallic bond and solid phase diffusion. The aluminum alloy part thus formed will show a sufficient strength.

An aluminum oxide layer is formed mainly while forming powder and heating the powder compact. In forming a part from an aluminum powder alloy, if the powder compact is heated to 300° C. or higher, the crystal water adsorbed to the aluminum powder particles will evaporate and react with aluminum, thus forming a strong oxide layer on the powder particle surface. This will, as described above, inhibit the bond between the powder particles. The part thus made will have an insufficient strength.

Rapidly solidified aluminum powder containing transition elements such as Fe, Ni and Cr includes microscopic depositions of intermetallic compounds of these transition elements and aluminum (such as $FeAl^3$, $NiAl^3$ and $CrAl^3$). The intermetallic compounds that deposit in the aluminum alloy powder have extremely small diffusion coefficients with respect to the aluminum matrix. Thus, when hot-forging such aluminum alloy powder, if the powder contains a transition element or elements in great amounts, the intermetallic compounds that have grown large when heated will inhibit the diffusion bond between the aluminum powder particles. This makes it difficult to provide an aluminum powder alloy member having sufficient strength and toughness.

The method of manufacturing an aluminum powder alloy member as described above is proposed e.g. in Japanese Patent Unexamined Publication 63-60265, in which the powder compact is subjected to heat treatment in the atmosphere in order to remove the water content which has been adsorbed to the surfaces of the powder particles. But as described above, the water content that has been removed will react with aluminum again, thus forming strong aluminum oxide layers on the powder particle surfaces. This inhibits the bond between particles. Further, in this publication, in order to sufficiently destroy the oxide layers on the powder particle surfaces and thus to bond the particles together, after heating the powder compact, a closed type hot-forging as a preparatory step is carried out and then hot-forging is carried out twice. Thus, this method tends to be costly.

Heretofore, trials have been made to improve the wear resistance of a sliding member made of aluminum alloy by adding Si crystals or hard particles such as SiC, TiC and $Al_2O_3$ particles. But if the atmospheric temperature exceeds 100° C. due to frictional heat during operation, the aluminum forming the matrix of the sliding member will begin to soften and the strength of the member lower. Thus, the frictional member becomes more prone to mechanical damage due to sliding and friction. Also, due to the shearing force acting while in frictional contact, Si crystals or hard particles may drop off, This reduces the wear resistance of the friction member.

An object of the present invention is, by use of the rapidly solidified powder metallurgical method together with the sizing method, to generate a rotor for an oil pump which is comparable in the dimensional accuracy and the wear resistance to a rotor made of a ferrous sintered material. Another object is to provide an economical manufacturing method in which the rate of the remaining pores in the solidified powder is adjusted to a level required for the sizing and thereby the drop in strength of the solidified powder is restricted, while keeping a microscopic and uniform metastable alloy phase which is necessary for higher wear resistance.

DISCLOSURE OF THE INVENTION

As a result of various experiments and research, the present inventors have succeeded in developing a rotor for an oil pump which is made of an aluminum alloy powder containing transition elements and which has high dimensional accuracy and high wear resistance and a fairly easy and economical method of manufacturing such a rotor.

According to the present invention, there is provided a rotor for an oil pump comprising an inner rotor and an outer rotor and made of an aluminum powder alloy, the outer peripheral surface or inner peripheral surface of each rotor having the shape of a trochoid curve or an involute curve or any other toothed shape comparable to them in performance, one or both of the inner and outer rotors being generated by the powder metallurgical method, From another aspect of the present invention, there is provided a method of manufacturing a rotor for an oil pump, comprising a first step of forming an aluminum alloy powder in a cold or warm environment to obtain a powder compact having a forming density of 75–93%, a second step of heating the compact in the atmosphere of an inert gas such as nitrogen and argon at temperature of 300°–560° C. for 0.25 to 3 hours, a third step of either hot-extruding the powder compact at a temperature of 300°–560° C. at the extrusion rate of 3 or less and compressing the compact axially, or conversely, compressing the powder compact axially to reduce the rate of pores to 3–5% and hot-extruding the same, thereby removing completely any microscopic pores in the surface layer of the solidified compact at portions kept in contact with axially extending surfaces of a metal mold, with pores left in the central part of the compact, the rate of pores being 2–5%, and a fourth step of subjecting the solidified compact obtained in the third step to sizing treatment in a cold or warm environment, whereby obtaining the rotor having high dimensional accuracy compared with conventional aluminum forgings.

BEST MODE FOR EMBODYING THE INVENTION

Figure 1:
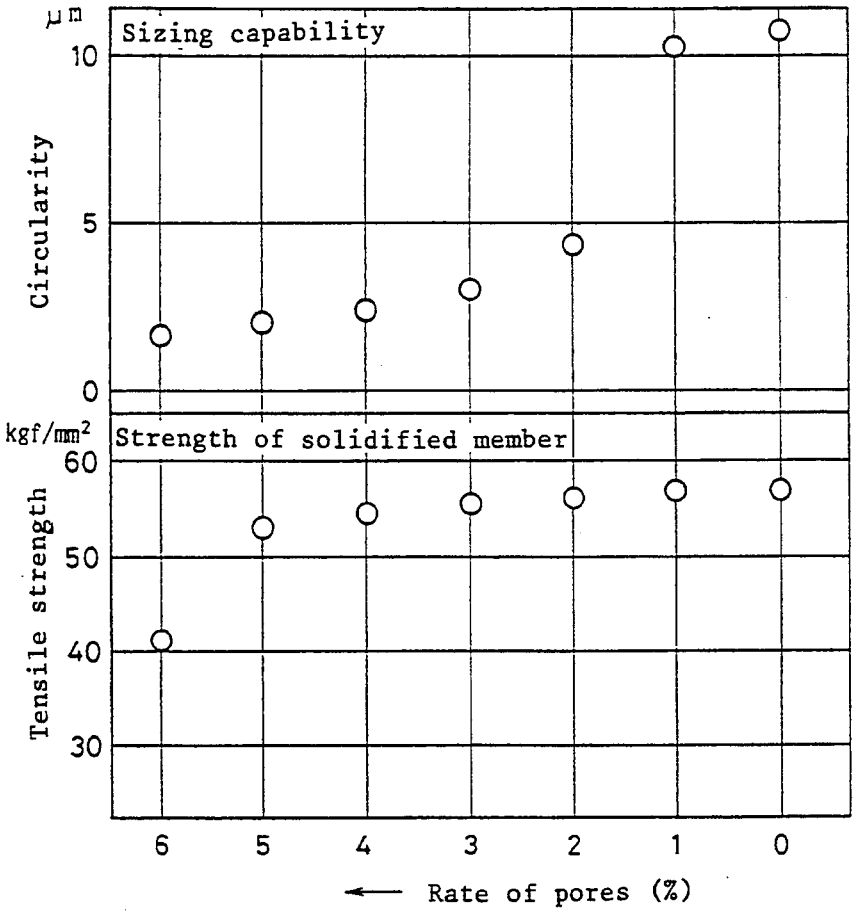
FIG. 1 is a graph showing the relation between the sizing capacity of the alloy having the composition shown in Table 1 and the strength of the solidified compact and the rate of remaining pores.

We shall first describe the function and the content of each of the component of the alloy. Amounts of elements are by weight unless otherwise specified.

First Alloy Element

Si: Diffused microscopically in the aluminum matrix, silicon serves to improve the strength of the matrix and to prevent the growth of the intermetallic compounds of aluminum and transition elements to be described later, such as Fe, Ni and Cr. If its content is less than 5%, the effects will not be sufficient. If more than 17%, the particle diameter of the primary crystals of silicon will become so great that the strength and toughness of the alloy drop and the forgeability worsens.

Second Alloy Elements

Fe: This element serves to improve the high-temperature strength of the matrix by producing metallic compounds of aluminum and Fe (such as $FeAl_3$). If the content is less than 3%, no sufficient improvement in the property can be expected. If more than 10%, the intermetallic compounds will grow so large that the strength and toughness of the alloy will drop.

Ni: Similar to Fe, this element serves to improve the high-temperature strength of the matrix by producing intermetallic compounds of aluminum and Fe (such as NiAl and $NiAl_3$). If the content is less than 3%, no sufficient improvement in the property can be expected. If more than 10%, the intermetallic compounds will grow so large that the strength and toughness of the alloy will decrease.

Cr: This element serves to increase the corrosion resistance. Also, the strength of the matrix increases because this element diffuses microscopically into the matrix and also microscopic intermetallic compounds of Al and Cr (such as $CrAl_3$) are produced. If the content is less than 1%, the effects are not sufficient. If more than 8%, the effects will not improve any more and even worse, the crystallized product will grow and the strength and toughness of the matrix decrease.

The transition elements reveal the above-mentioned effects individually as far as the contents are within the prescribed ranges. But if the total content of one or more of the above elements is greater than 15%, the effects will not improve any more. Further, since elements having high melting point are added in a great amount in preparing the material powder, the temperature necessary for melting the powder uniformly increases. This pushes up the material cost.

Third Alloy Elements

Mo, V, Zr: These elements diffuse microscopically and uniformly into the matrix and serve to increase the strength of the aluminum matrix, If the content of each element is less than 1%, the effect is not sufficient. If the overall content of these element is more than 5%, the notch sensitivity of these diffused particles increases. This lowers the strength of the matrix.

Fourth Alloy Elements

Cu and Mg: Both serve to improve the mechanical properties of the matrix such as strength and hardness by solution treatment, Also, they deposit on the aluminum matrix, thereby preventing the growth of the intermetallic compounds between aluminum and transition elements such as Fe, Ni and Cr. If the content of Cu is less than 1%, its effect will not be sufficient. If more than 5%, not only will its effect not improve any further but also the corrosion resistance will decrease, If the content of Mg is less than 0.5%, the effect will not be sufficient. If more than 1.5%, not only will the effect not improve, but the crystallized product will grow too much and the strength and toughness of the matrix drop.

Mn: This element serves to increase the strength of the aluminum alloy by solution treatment and by changing the alloy into a fibrous structure. It also serves to prevent the growth of the intermetallic compounds of aluminum and transition elements such as Fe, Ni and Cr. If its content is less than 0.2%, the effect is not sufficient. If more than 1%, not only will the effect not improve any further, but the strength and toughness of the matrix will drop because coarse crystallized particles are produced. The remainder of the alloy is aluminum and unavoidable impurities.

But if the rapidly solidified powder made up of the components set forth in the claims is cooled at a speed slower than $10^{2}$° C./sec., the intermetallic compounds and the structure will grow excessively. Thus, the above-described excellent properties will not be expected. If the cooling speed is higher than $10^{6}$° C./sec., not only will the above properties not improve any further, but this will lead to increased cost of the powder.

On the other hand, rapid solidification will have no effect on an I/M alloy, which has the same composition, compared with a P/M alloy. Thus, it is difficult to impart the abovesaid properties to an I/M alloy.

Therefore, the sliding member according to the present invention is made of an aluminum alloy powder which has a predetermined composition as specified in the claims and which is solidified at a cooling rate between $10^{2}$° C./sec. and $10^{6}$° C./sec.

Next, we shall describe a fairly easy and economical method for generating a solidified powdery member having high dimensional accuracy, using an aluminum alloy powder having a composition as set forth in the claims.

As described above, the rate of pores in the solidified powder member is considered to be closely related to the sizing capability for shaping a solidified powder member with high accuracy by closing the pores and to the strength of the member.

We thought that the rate of pores is of utmost importance. Based on this assumption, we tried to optimize the rate of pores in manufacturing a rotor for an oil pump with the powder metallurgical technique. The rotor thus formed had high dimensional accuracy and excellent wear resistance and sliding properties. We shall now discuss detailed manufacturing conditions.

The dimensions of a powder compact may change during hot extrusion or hot forging due to thermal expansion and shrinkage of the metal mold or die and the powder compact. It was thus difficult to obtain a solidified powder member having high dimensional accuracy comparable to a ferrous sintered part with the conventional powder metallurgy alone.

Thus, we tried an alternative method in which pores are left in the solidified powder member and the pores are partially collapsed by applying pressure during sizing, while preventing a plastic deformation of the member as a whole, so as to deform the member locally into a shape complementary to the shape of the mold. Thus, the member keeps high dimensional accuracy. Also, we sought an optimum rate of remaining pores at which the member keeps high strength.

The decrease in the strength of the member caused by the remaining pores may be due to stress concentration in the pores resulting from the shape of so-called communicating pores and deterioration of the grain boundary by an oxidizing atmosphere containing water that infiltrates into the member through the communicating pores. In order to solve this problem, we tried to round off as much as possible the remaining pores and to eliminate any communicating pores to allow only mutually isolated pores to exist.

In an ordinary powder metallurgical technique, the remaining pores change its form from communicating pores to isolated pores at the relative density of about 94%. If the pores are communicating pores, the surrounding atmosphere can infiltrate into the pores and often reacts with the member. If the pores are isolated, the surrounding atmosphere infiltrates into the member through the surface layer at a controlled rate. The reaction is thus very slow. When the old powder is deformed and their grain boundaries come into contact with one another, the air gaps shrink. But it is virtually impossible to eliminate the air gaps that remain at e.g. triple points of the grain boundaries. Whether or not the air gaps communicate three-dimensionally with one another depends practically solely on the relative density. As described above, the relative density of 94% is the borderline.

On the other hand, in the powder metallurgical method, surface defects such as pores and powder-missing portions develop at portions where the heated powder compact comes into contact with a metal mold or die, i.e. on the surface layer of the compact. Thus, the strength tends to be low where black scale remains.

This happens because the surface temperature of the heated powder compact drops when it contacts the mold or die; deformation of the powder becomes difficult; as a result, the oxide layer formed on the powder surface is not broken and destroyed sufficiently; this inhibits metallic bonding and diffusion bonding between the powder particles; as a result, air gaps remain at such parts as triple points of the grain boundaries. This problem can be effectively prevented by increasing the temperature of the mold. But this increases the possibility of seizure between the mold and the powder compact. Thus, it becomes difficult to shape the compact with high dimensional accuracy.

Also, since the surface of the heated powder compact tends to adsorb water in the air, its surface layer is exposed to an oxidizing atmosphere. Thus, oxide layers tend to develop on the particle surfaces, making it difficult to bond the powder particles together. Also, during hot treatment, any water content and other organic components that remain in the powder compact will evaporate or be decomposed and released into the atmosphere through the grain boundaries. But since the temperature at the surface layer is rather low in this state, no sufficient evaporation or decomposition occur. This will lower the bonding property between the powder particles and the strength.

Thus, in the first step, the relative density of the powder compact is restricted within such a range that communicating pores exist (75–93%). After heating the compact in the atmosphere of an inert gas such as nitrogen or argon (second step), the powder particles are bonded together while isolating the pores in a hot environment where the yield strength of the material decreases (third step). At that time, the surface layer is subjected to shear deformation to produce plastic flow and thus to remove the above said surface defects, while leaving isolated pores in the central parts of the powder solidified body. The oxide layers on the surfaces of the powder particles will be fully broken and destroyed, so that the powder particles will be closely bonded together and the surface layer be made dense. In the subsequent fourth step, sizing is carried out using the isolated pores that remain in the central parts of the powder solidified body.

In this step, it is essential that pores remain in the powder solidified body. We examined the influence of the remaining pores on the strength of the solidified powder member. The result reveals that it is necessary to deform the powder particles to such an extent that the rate of pores in the solidified powder member will be 2–5% as shown in FIG. 1 in order for the solidified member to have a sufficient strength when compared with the state of true density (the composition of the powder used is shown in Table 1). Also, in order to carry out sizing treatment using remaining pores, the rate of the pores have to be adjusted to an optimum level. It turned out that, in carrying out the first step of the present invention using an aluminum powder alloy, sizing is possible if the rate of pores is 2% or more. Even if the rate of pores is over 2%, sizing is possible. But if this rate is too high, the strength of the member will drop too much to be acceptable. If the rate of pores is 2% or lower, sizing will become more like forging, so that the resistance to deformation as well as residual strain will increase and the seizure may occur. This worsens the dimensional accuracy.

Next we shall describe more in detail the first to fourth steps.

First Step

In order to leave isolated pores in the central part of the powder solidified member and to solidify the member by hot plastic deformation in the third step, it is necessary to sufficiently decompose any water content and other organic substances that exist in the powder compact and to expel them from the compact through the grain boundaries. For this purpose, the relative density of the powder compact in the first step has to be within such a range that communicating pores are present (75–93%).

Since it is the object of the present invention to manufacture a mechanical part made of a high-performance aluminum alloy and having high dimensional accuracy, it is required that the compact can be formed into a complicated shape. Such a complicated shape can be produced in the first step by cold-pressing the powder. When forming a powder compact less complicated in shape, however, the powder may be formed in a warm environment. In carrying out the method of the present invention, a relatively coarse powder should preferably be used. This is because in generating a powder solidified member having a complicated shape with high accuracy, it is necessary that the density of the powder compact at different parts be uniform and the variation in dimension when heated be minimized. But, it is extremely difficult to uniformly fill into a mold fine aluminum powder having low flowability by handling at high speed. Thus, in order to improve the flowability, coarse powder is preferable. Also, it is important in handling fine powder to prevent powder from dropping in the clearance between the mold and the compact and seizing to the mold.

Second Step

Heating treatment is an essential step in order to evaporate and remove any water content and any other organic substances adsorbed to the aluminum alloy powder particles and thus to bond the powder particles together completely. The optimum heating conditions are determined as follows: atmosphere: inert gas such as nitrogen and argon, heating temperature: 300°–560° C., heating time: 0.25–3 hours.

If the heating temperature is less than 300° C., or the heating time is less than 0.25 hour, the water content and other organic substances adsorbed to the powder particles would not be evaporated and removed sufficiently. But, as described above, even if the crystal water adsorbed to the aluminum alloy powder particles is evaporated by heating the preform to 300° C. or higher, the water may react with the aluminum again, thus forming aluminum oxide layers on the surface of the powder. This has a bad effect on the bonding between the powder particles. By heating the powder preform in the atmosphere of an inert gas such as nitrogen and argon, reaction between the evaporated crystal water and the aluminum is prevented. This in turn prevents the formation of aluminum oxide layers. On the other hand, if the heating temperature is more than 560° C. or the heating time is longer than 3 hours, the microscopic structure in the powder is damaged and the properties of the powder obtained by the rapid solidifying treatment will be lost. For the above reasons, heating treatment of the powder preform is carried out in an inert gas such as nitrogen and argon, at a heating temperature of 300°-560° C., with heating time: 0.25-3 hours.

Third Step

The first method for hot treatment is as follows: Hot coining is carried out by axial compression at 300°-560° C. Then the surface layer of the powder compact is subjected to shearing deformation by hot extrusion with the extrusion ratio of 3 or less to produce a plastic flow, thereby removing any microscopic air gaps that remain in the surface layer while leaving isolated pores in the central part of the compact. The solidified powder member thus formed has pores at the rate of 2-5%. If the extrusion ratio is greater than 3, the plastic flow due to extrusion will reach the central part, causing the powder particles at the central part of the compact to be pressed against and bonded to each other. As a result, the pores in the central part, which are necessary for sizing, will collapse and disappear, thus making impossible the adjustment of dimensions.

One can expect a similar effect by initially subjecting the heated powder compact to hot extrusion (second method). In this case, however, it is necessary to apply back pressure on the surface opposite to the pressurized surface to prevent the formation of cracks on the surface layer and thus to produce a non-defective solidified powder member.

Fourth Step

Sizing treatment may be carried out in the cold, that is, at normal temperatures without positively heating the metal mold or may be carried out by heating the mold to a temperature of 300° C. or lower. Which should be selected depends on the shape of the compact, required dimensional accuracy in the second step, kind of material to be forged, etc. When sizing, it is preferable to use a liquid lubricant such an ordinarily used oil or a solid lubricant.

If it is desired to further increase the strength of the rotor member thus made of an aluminum powder alloy, it may be subjected to a known heat treatment such as T4 or T6 treatment, if the aluminum powder alloy contains transition elements.

EXAMPLE 1

We manufactured rings of 80 mm (outer diameter)×60 mm (inner diameter)×10 mm (thickness), using rapidly solidified aluminum alloy powders having compositions A-O as shown in Table 2 under the manufacturing conditions shown in Table 3. The materials A-J shown in Table 2 are rotor materials according to the present invention and K-O are alloys prepared for comparison purposes. Specimen Nos. 1-15 were made with the method according to the present invention. Nos. 16-20 were made for comparison with a method other than the method according to the present invention. These specimens were tested for various properties (tensile strength and elongation) and dimensional accuracy (roundness of the inner and outer diameters and variations in thickness). The results are shown in Table 3.

In Table 3: Nos. 1-10 are members manufactured using the alloy and the method as defined in the claims of the present invention; and Nos. 11-15 are members manufactured using alloys for comparison and the method defined in the claims of the present invention, of which 11; Si content was zero (in the pump performance test shown in Table 4, adhesion wear and scuffs developed)

12; due to excessive Si content, strength and toughness dropped

13; since transition elements (Fe, Ni, Cr) were contained at the rate of more than 15% in total, strength and toughness dropped 14; ditto 15; since hard particles (V, Zr, Mo) were contained at the rate of more than 5% in total, strength and toughness dropped Nos. 16-20 are members manufactured using comparative methods, of which 16; since heating temperature was higher than a preferable range, the structure grew too coarse and the toughness dropped 17; since heating was conducted for a longer period than a preferable range, strength and toughness dropped 18; since heating was conducted in the atmosphere, oxide layers developed on the powder particles, which hampered the bond between powder particles, so that strength and toughness dropped 19; since sizing treatment after hot forging was omitted, both the inner and outer diameter were not precise enough and variation in thickness was large.

EXAMPLE 2

Figure 2:
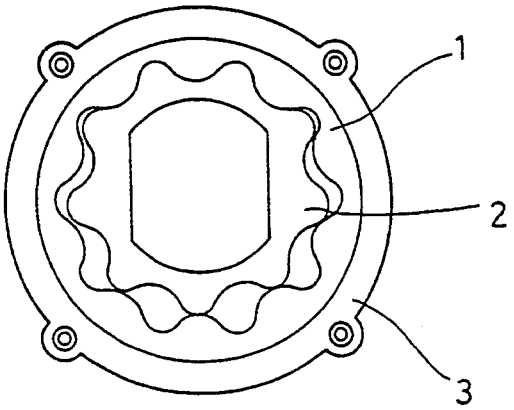
FIG. 2 is an end view of a pump rotor according to the present invention.

Outer rotors 1 and inner rotors 2 for oil pumps having a gear shape as shown in FIG. 2 were manufactured using the powder materials A-O in Table 2 with the method according to the present invention. They were combined as shown in Table 4 and mounted in a pump case 3. In order to evaluate the performance of the pumps, they were operated at a speed of 7000 rpm, at temperature of 150° C., with the oil pressure at 20 kg/cm$^2$, for 50 hours. The results of this operation test is shown in Table 4.

As shown in Table 4, in case of the pumps in which both rotors are made of an alloy according to the present invention, both rotors suffered no damage when brought into frictional contact. In contrast, in case of the pumps in which one or both of the rotors are made of alloys other than the alloy according to the present invention, the rotors suffered adhesion wear, scurfs and cracks.

As described above, according to the method of the present invention, a rapidly solidified aluminum alloy powder particles are bonded together strongly with a single hot-forging step while keeping the inherent properties of the material. Then by subjecting the material to sizing, the material can be finished with high dimensional accuracy.

Industrial Application

The rotor for an oil pump made with the method according to the present invention maintains high reliability even when used at high temperatures. This is because the powder particles forming the rotor are strongly bonded together and the dimensional accuracy is high (these effects are attributable to the improved manufacturing method of the present invention) and because of the effects brought about by the improved composition of the materials (wear and frictional resistance as well as high-temperature strength increase and its thermal expansion coefficient comes closer to that of the aluminum alloy for a pump case). Thus, the present invention makes it possible to make an A/T oil pump from a lightweight Al alloy. This serves to reduce the fuel consumption of automobiles. The present invention is also effective in reducing the weight of the peripheral parts of the pump. This will help improve the pump performance furthermore.

TABLE 1

| Fe | Ni | Cr | Si | Mo | V | Zr | Cu | Mg | Mn | Al |
|---|---|---|---|---|---|---|---|---|---|---|
| 5 | 6 | 2 | 12 | 1.5 | 1.5 | 1 | 3.5 | 1 | 0.5 | Remainder |

TABLE 2

| Type | Fe | Ni | Cr | Si | Mo | V | Zr | Cu | Mg | Mn | Al |
|---|---|---|---|---|---|---|---|---|---|---|---|
| A | 5 | 5 | 1.5 | 8 | 1.5 | 1.5 | 1 | 3.5 | 1 | 0.5 | Re- |
| B | 5 | 6 | 2 | 12 | 1.5 | 1.5 | 1 | 3.5 | 1 | 0.5 | main- |
| C | 4 | 6 | 5 | 16 | 1.5 | 1.5 | 1 | 3.5 | 1 | 0.5 | der |
| D | 5 | 5 | 2 | 17 | 2 | 2 | — | 4 | 1.5 | 0.5 | |
| E | 5 | 5 | 2.5 | 15 | 2 | — | 2 | 4 | 1.5 | 0.5 | |
| F | 5 | 5 | 1 | 16 | — | 2 | 2 | 4 | 1.5 | 0.5 | |
| G | 5 | 5 | 3 | 16 | 1.5 | 1.5 | 1 | 4 | 1.5 | 0.5 | |
| H | 8 | 4 | 2 | 15 | 1.5 | 1.5 | 1 | 3.5 | 1 | 0.5 | |
| I | 3 | 8 | 3 | 12 | 1.5 | 1.5 | 1 | 3.5 | 1 | 0.5 | |
| J | 3 | 4 | 6.5 | 12 | 1.5 | 1.5 | 1 | 3.5 | 1 | 0.5 | |
| K | 5 | 6 | 2 | — | 1.5 | 1.5 | 1 | 3.5 | 1 | 0.5 | |
| L | 5 | 6 | 2 | 25 | 1.5 | 1.5 | 1 | 3.5 | 1 | 0.5 | |
| M | 8 | 6 | 5 | 8 | 1 | 1 | 2 | 3.5 | 1 | 0.5 | |
| N | 6 | 10 | 4 | 8 | 1 | 1 | 2 | 3.5 | 1 | 0.5 | |
| O | 5 | 6 | 3 | 12 | 3 | 2.5 | 2 | 3.5 | 1 | 0.5 | |

(A~J; Alloy according to the Invention, K~O; Comparative alloy)

TABLE 3

| Type | Composition | Forming Pressure (t/cm²) | Heating Condition Temp (°C.) | Heating Condition Time (min.) | Heating Condition Atmosphere | Hot-forging Temp (°C.) | Hot-forging Pressure (t/cm²) | Sizing Temp (°C.) | Sizing Pressure (t/cm²) |
|---|---|---|---|---|---|---|---|---|---|
| 1 | A | 6 | 540 | 45 | $N_2$ | 460 | 8 | ord. | 6 |
| 2 | B | 7 | 540 | 45 | Ar | 460 | 8 | ord. | 6 |
| 3 | C | 8 | 540 | 45 | $N_2$ | 460 | 6 | ord. | 6 |
| 4 | D | 6 | 520 | 60 | $N_2$ | 440 | 8 | 100 | 6 |
| 5 | E | 7 | 520 | 60 | $N_2$ | 440 | 8 | 100 | 6 |
| 6 | F | 8 | 520 | 60 | $N_2$ | 440 | 6 | 100 | 6 |
| 7 | G | 8 | 520 | 60 | $N_2$ | 440 | 6 | 100 | 6 |
| 8 | H | 8 | 500 | 60 | Ar | 420 | 8 | ord. | 6 |
| 9 | I | 8 | 500 | 60 | $N_2$ | 420 | 8 | ord. | 6 |
| 10 | J | 8 | 500 | 60 | $N_2$ | 420 | 8 | ord. | 6 |
| 11 | K | 8 | 540 | 45 | $N_2$ | 460 | 8 | ord. | 6 |
| 12 | L | 8 | 540 | 45 | Ar | 460 | 8 | ord. | 6 |
| 13 | M | 8 | 520 | 60 | $N_2$ | 440 | 8 | 100 | 6 |
| 14 | N | 8 | 520 | 60 | $N_2$ | 440 | 8 | 100 | 6 |
| 15 | O | 8 | 500 | 60 | $N_2$ | 420 | 8 | ord. | 6 |
| 16 | A | 8 | 580 | 45 | $N_2$ | 480 | 8 | ord. | 6 |
| 17 | A | 8 | 540 | 5 | $N_2$ | 460 | 8 | ord. | 6 |
| 18 | A | 8 | 540 | 45 | air | 460 | 8 | ord. | 6 |
| 19 | A | 8 | 540 | 45 | $N_2$ | 460 | 6 | — | — |
| 20 | A | 8 | 540 | 45 | $N_2$ | 460 | 8 | — | — |

| Type | Rate of pores in the forging (%) | Properties of the member after sizing: Roundness of outer diam. (μm) | Roundness of inner diam. (μm) | Variation in thickness (μm) | Tensile strength (kgf/mm²) | Elongation (%) |
|---|---|---|---|---|---|---|
| 1 | 2 | 11 | 7 | 8 | 58.0 | 2.0 |
| 2 | 2 | 13 | 9 | 7 | 56.5 | 1.5 |
| 3 | 4.5 | 9 | 5 | 6 | 56.0 | 1.0 |
| 4 | 2 | 15 | 10 | 8 | 57.5 | 1.0 |
| 5 | 2 | 12 | 7 | 8 | 58.0 | 1.0 |
| 6 | 4.5 | 10 | 7 | 6 | 57.0 | 1.0 |
| 7 | 5 | 9 | 6 | 7 | 58.5 | 0.7 |
| 8 | 2.5 | 14 | 10 | 8 | 60.5 | 1.5 |
| 9 | 2 | 13 | 11 | 8 | 59.0 | 1.5 |
| 10 | 2 | 14 | 10 | 8 | 57.0 | 1.5 |
| 11 | 3 | 9 | 7 | 6 | 53.0 | 4.5 |
| 12 | 2 | 12 | 9 | 8 | 48.0 | 0.1 |
| 13 | 2.5 | 12 | 8 | 8 | 45.5 | 0.1 |
| 14 | 2 | 10 | 8 | 7 | 42.0 | 0.0 |
| 15 | 2 | 11 | 9 | 5 | 43.5 | 0.0 |
| 16 | 2 | 11 | 8 | 6 | 48.0 | 0.0 |
| 17 | 2.5 | 10 | 9 | 5 | 39.5 | 0.0 |
| 18 | 2 | 12 | 10 | 7 | 35.0 | 0.0 |
| 19 | 5 | 47 | 32 | 23 | 55.5 | 1.5 |
| 20 | 2 | 52 | 29 | 26 | 56.5 | 2.0 |

(1~15; Alloys made by the method according to the invention, 16~20; Alloys made by comparative method) (Ord. for Temperature stands for ordinary temperature.)

TABLE 4

| Type | | | Outer rotor | | | | | | | | | | | | | | |
|---|---|---|---|---|---|---|---|---|---|---|---|---|---|---|---|---|---|
| | | | Alloys according to the invention | | | | | | | | | | Comparative alloys | | | | |
| | | | A | B | C | D | E | F | G | H | I | J | K | L | M | N | O |
| Inner rotor | Alloys according to the Invention | A | ◎ | ◎ | ◎ | ◎ | ◎ | ◎ | ◎ | ◎ | ◎ | ◎ | Δ | X | X | X | X |
| | | B | — | ◎ | ◎ | ◎ | ◎ | ◎ | ◎ | ◎ | ◎ | ◎ | Δ | X | X | X | X |
| | | C | — | — | ◎ | ◎ | ◎ | ◎ | ◎ | ◎ | ◎ | ◎ | Δ | X | X | X | X |
| | | D | — | — | — | ◎ | ◎ | ◎ | ◎ | ◎ | ◎ | ◎ | Δ | X | X | X | X |
| | | E | — | — | — | — | ◎ | ◎ | ◎ | ◎ | ◎ | ◎ | Δ | X | X | X | X |
| | | F | — | — | — | — | — | ◎ | ◎ | ◎ | ◎ | ◎ | Δ | X | X | X | X |
| | | G | — | — | — | — | — | — | ◎ | ◎ | ◎ | ◎ | Δ | X | X | X | X |
| | | H | — | — | — | — | — | — | — | ◎ | ◎ | ◎ | Δ | X | X | X | X |
| | | I | — | — | — | — | — | — | — | — | ◎ | ◎ | Δ | X | X | X | X |
| | | J | — | — | — | — | — | — | — | — | — | ◎ | Δ | X | X | X | X |
| | Comparative | K | ∇ | — | ∇ | — | ∇ | — | ∇ | — | ∇ | — | Δ/∇ | X | — | X | — |
| | | L | — | — | — | — | — | — | — | — | — | — | — | — | X | — | X |
| | | M | — | — | — | — | — | — | — | — | — | — | — | — | — | X | — |

◎: No wear damage at frictional part; good pump performance
Δ: Adhesion wear between outer rotor and pump case
∇: Adhesion wear or scuffs at toothed part of rotor
X: Rotor broken during frictional movement
—: No evaluation made

We claim:

1. A method of manufacturing a rotor for an oil pump, said method comprising a first step of forming an aluminum alloy powder in a cold or warm environment to obtain a powder compact having a density of 75-93%, a second step of heating said compact in an atmosphere of an inert gas at a temperature of 300°-560° C. for 0.25-3 hours, a third step of either hot-extruding said powder compact at a temperature of 300°-560° C. at the extrusion rate of 3 or less and compressing said compact axially, or conversely, compressing said powder compact axially to reduce the rate of pores to 3-5% and hot-extruding it, thereby removing completely any microscopic pores in the surface layer of the resultant solidified compact at portions kept in contact with axially extending surfaces of a metal mold, with pores left in the central part of said compact, the rate of such pores being 2-5%, and a fourth step of subjecting the solidified compact obtained in said third step to sizing treatment in a cold or warm environment, whereby the rotor thus obtained has high dimensional accuracy compared with a conventional rotor made by aluminum forgings.

2. A method of manufacturing a rotor for an oil pump as claimed in claim 1 wherein in the third step the compact is preheated to 300°-560° C. for 15 minutes to 3 hours, said third step being carried out with the temperature of said mold maintained at 300°-560° C.

3. A method of manufacturing a rotor for an oil pump as claimed in claim 1 wherein the inert gas is nitrogen or argon.

4. A rotor for an oil pump comprising an inner rotor and an outer rotor both made of an aluminum powder alloy, the inner or outer peripheral surface of said rotors having the shape of a trochoid curve or an involute curve or any other toothed shape suitable as a pump rotor, one or both of said inner and outer rotors being generated by the powder metallurgical method, wherein said rotor is made of an aluminum powder alloy obtained by rapidly solidifying a material alloy at a cooling rate of $10^2$-$10^6$° C./sec, and containing, in terms of weight, 5-17% of Si as a first alloy element; a total of 15% or less of transition elements as second alloy elements comprising 3-10% of Fe, 3-10% of Ni and 1-8% of Cr; a total of 5% or less of at least one alloy element as third alloy elements selected from the group consisting of Mo, V, Zr each 1-5%; and 1-5% of Cu, 0.2-1.5% of Mg and 0.2-1% of Mn as fourth alloy elements; the remainder being aluminum and unavoidable impurities whereby said rotor reveals excellent mechanical properties at normal and high temperatures.

* * * * *